US009755302B2

(12) United States Patent
Flores-Cuadras et al.

(10) Patent No.: US 9,755,302 B2
(45) Date of Patent: Sep. 5, 2017

(54) MULTIPATH OPEN LOOP ANTENNA WITH WIDEBAND RESONANCES FOR WAN COMMUNICATIONS

(71) Applicant: Taoglas Group Holdings Limited, Enniscorthy (IE)

(72) Inventors: Javier Ruben Flores-Cuadras, Tijuana (MX); Ming Wei-Chen, Zhongli (TW)

(73) Assignee: Taoglas Group Holdings Limited, Enniscorthy (IE)

( * ) Notice: Subject to any disclaimer, the term of this patent is extended or adjusted under 35 U.S.C. 154(b) by 0 days.

(21) Appl. No.: 14/603,201

(22) Filed: Jan. 22, 2015

(65) Prior Publication Data

US 2015/0303556 A1 Oct. 22, 2015

Related U.S. Application Data

(60) Provisional application No. 61/930,143, filed on Jan. 22, 2014.

(51) Int. Cl.

| | |
|---|---|
| ***H01Q 21/00*** | (2006.01) |
| ***H01Q 1/38*** | (2006.01) |
| ***H01Q 1/08*** | (2006.01) |
| ***H01Q 1/24*** | (2006.01) |
| ***H01Q 7/00*** | (2006.01) |
| ***H01Q 5/364*** | (2015.01) |
| ***H01Q 5/392*** | (2015.01) |

(52) U.S. Cl.

CPC ..... *H01Q 1/38* (2013.01); *H01Q 1/085* (2013.01); *H01Q 1/243* (2013.01); *H01Q 5/364* (2015.01); *H01Q 5/392* (2015.01); *H01Q 7/00* (2013.01)

(58) Field of Classification Search

None

See application file for complete search history.

(56) References Cited

U.S. PATENT DOCUMENTS

| | | | | |
|---|---|---|---|---|
| 2006/0214867 | A1* | 9/2006 | Chen | H01Q 9/285 343/795 |
| 2007/0046557 | A1* | 3/2007 | Chen | H01Q 9/26 343/795 |
| 2012/0127056 | A1* | 5/2012 | Park | H01Q 1/521 343/853 |

* cited by examiner

*Primary Examiner* — Trinh Dinh

(74) *Attorney, Agent, or Firm* — Coastal Patent Law Group, P.C.

(57) ABSTRACT

The disclosure concerns an antenna with open loops and multipath current distribution to achieve ultra wideband characteristics and antenna miniaturization, while simultaneously keeping high performance for a more reliable WAN communication, with higher data transfer, less dropping connections and improved sensitivity. To further reduce spatial requirements, the antenna may be incorporated on a flex substrate for bending with the contour of a device housing or the like.

5 Claims, 7 Drawing Sheets

MULTIPATH OPEN LOOP ANTENNA WITH WIDEBAND RESONANCES FOR WAN COMMUNICATIONS

CROSS-REFERENCE TO RELATED APPLICATIONS

This application claims benefit of priority with U.S. Provisional Application Ser. No. 61/930,143, filed Jan. 22, 2014; the contents of which are hereby incorporated by reference.

BACKGROUND

Field of the Invention

The claimed invention relates to antennas; and more particularly, to such antennas having open loop conductors with multi-path current distributions for achieving multiple wideband resonances for use in WAN communications.

Description of the Related Art

New methodologies and techniques for antenna miniaturization, and further widening the response across multiple frequencies are in present high demand. The wide area network (WAN) main spectrum is allocated from 698 MHz to 3000 MHz, including most of the cellular bands around the World.

This demand drives a present need for novel and differentiated antenna configurations and topologies which provide useful wide band operation.

Moreover, those with skill in the art recognize that it is very difficult to design an antenna with stable radiation performance across the ultra-wide bandwidth. Conventional antenna topologies and configurations look for one or two paths to obtain lower and upper resonances (around 800 MHz and 1900 MHz), with other techniques to widen the resonances, getting more bandwidth. However, this conventional technique generally results in more space per each element, and such space is not something that is available with modern device constraints.

There is a need for an alternative solution for providing ultra-wide band resonances with reduced spatial requirements.

SUMMARY

An antenna is disclosed which provides open loops and multipath current distribution to achieve ultra wideband characteristics and antenna miniaturization, while simultaneously keeping high performance for a more reliable WAN communication, with higher data transfer, less dropping connections and improved sensitivity. To further reduce spatial requirements, the antenna may be incorporated on a flex substrate for bending with the contour of a device housing or the like.

DETAILED DESCRIPTION

In the following description, for purpose of illustration and not limitation, detailed descriptions are provided in an effort to enable those having skill in the art to make and use the inventive embodiments. It will be understood by those with skill in the art that various modifications and alterations may be practiced, with only limited experimentation, in order to achieve the substantial result of the invention as set forth in the claims.

Figure 1A:
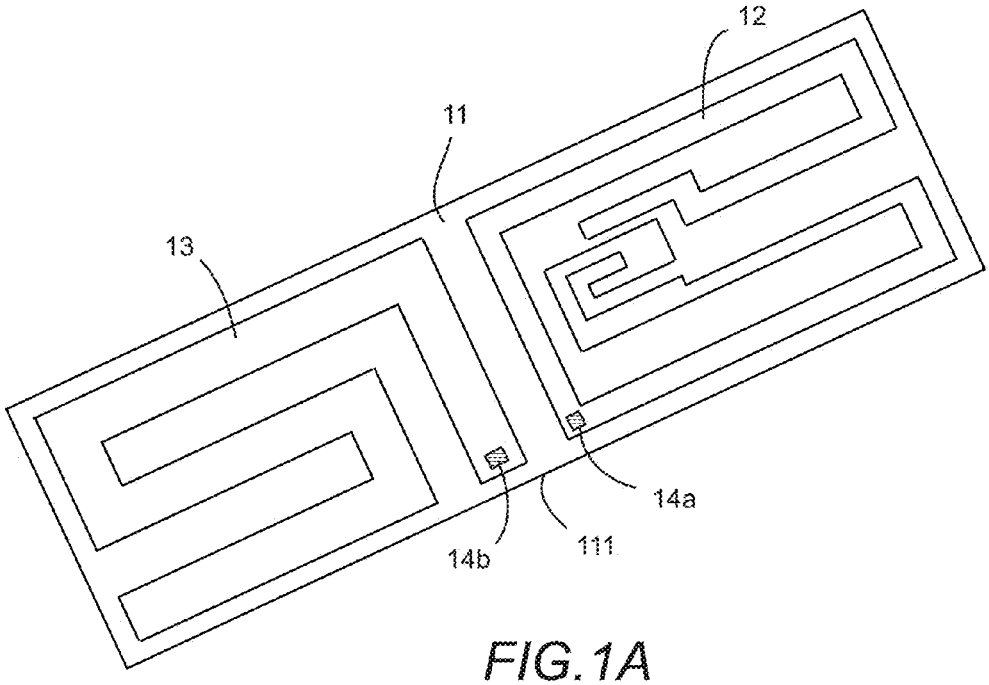
FIG. 1A shows an isometric view of a multipath open loop antenna in accordance with an illustrated embodiment.

Now turning to the drawings, FIG. 1A shows an isometric view of a multipath open loop antenna in accordance with an illustrated embodiment. The antenna comprises a flexible substrate sheet 11 having an open-loop ground conductor portion 13 and an open-loop radiating portion 12. The ground conductor 13 comprises a ground solder pad 14*b* disposed adjacent to each of: a peripheral edge 111 of the substrate, and the centerline (C') thereof. The radiating portion 12 comprises a feed solder pad 14*a* disposed adjacent to each of: a peripheral edge 111 of the substrate, and the centerline (C') thereof.

Figure 1B:
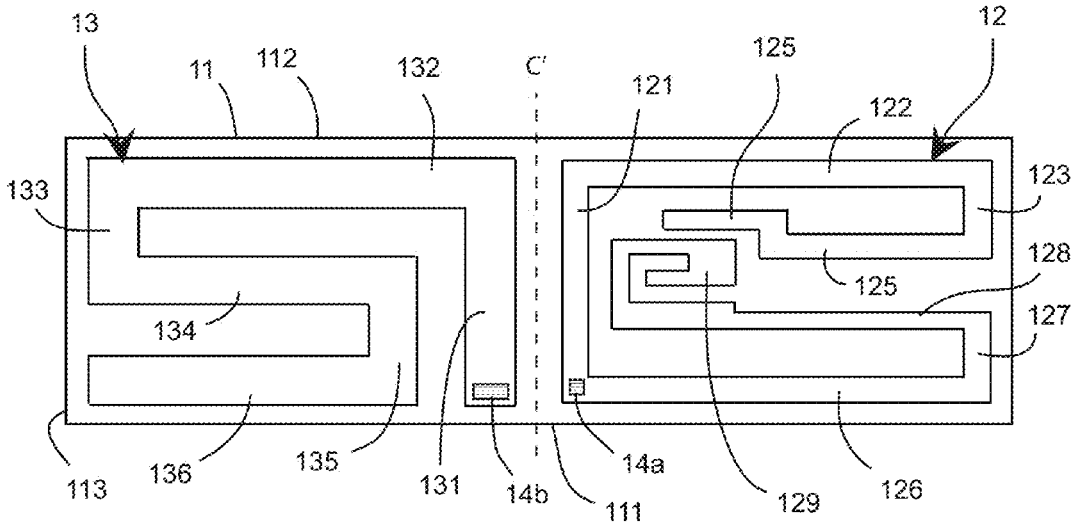
FIG. 1B details the conductor portions of the multipath open loop antenna of FIG. 1A.

FIG. 1B further details the antenna of FIG. 1A. The substrate 11 comprises a length longer than a width of the substrate, and a thickness much less than the length and width, forming a flexible substrate sheet. The length of the substrate is bisected at the centerline (C'). The open-loop ground conductor 13 is disposed on the substrate at a first side with respect to the center line (shown as the left side in FIG. 1B), and the open-loop radiating portion 12 is disposed on the substrate at a second side opposite of the first side with respect to the centerline (shown as the right side in FIG. 1B).

The open-loop ground conductor 13, comprises, in series, a first vertical ground conductor portion 131, a first horizontal ground conductor portion 132, a second vertical ground conductor portion 133, a second horizontal ground conductor portion 134, a third vertical ground conductor portion 135, and a third horizontal ground conductor portion 136. The first through third horizontal ground conductor portions are each disposed parallel to one another and at least partially overlapping with one another.

The first vertical ground conductor portion 131 extends parallel to the centerline of the substrate from the first peripheral edge 111 to a second peripheral edge 112 opposite of the first peripheral edge.

The first horizontal ground conductor portion 132 extends parallel with the second peripheral edge of the substrate from the first vertical ground conductor portion 131 to a corner of the substrate defined at the intersection of the second peripheral edge 112 and the terminal edge 113 of the substrate.

The second vertical ground conductor portion 133 extends parallel with the centerline along the terminal edge 113 of the substrate from the first horizontal ground conductor portion 132 to the second horizontal ground conductor portion 134.

The third vertical ground conductor portion 135 extends parallel with the centerline from the second horizontal ground conductor portion 134 to the third horizontal ground conductor portion 136.

Each of the ground conductor portions 131-136 forms a ground conductor having an open-loop configuration with three regions of overlap; i.e. a first region of overlap between the first and third vertical ground conductors 131 and 135; the first and second horizontal ground conductors 132 and 134; and the second and third horizontal ground conductors 134 and 136, respectively. As will be identified herein, the open-loop ground conductor provides multiple ground paths for achieving multiple resonances.

The open-loop radiating portion comprises: a first conductor section and a second conductor section, each conductor section extending from a point of feed (feed solder pad 14*a*).

The first conductor section includes: a first vertical element 121, a first horizontal element 122, a second vertical element 123, and at least a second horizontal element 125. The first conductor section is configured to overlap with itself for providing a first loop region.

The second conductor section comprises a first horizontal element 126, a first vertical element 127, and at least a second horizontal element 128. The second conductor section is configured with one or more overlapping elements forming at least a second loop region, and optionally a third loop region 129. The multiple loop regions provide a plurality of distinct current paths and associated resonances.

Figure 2A:
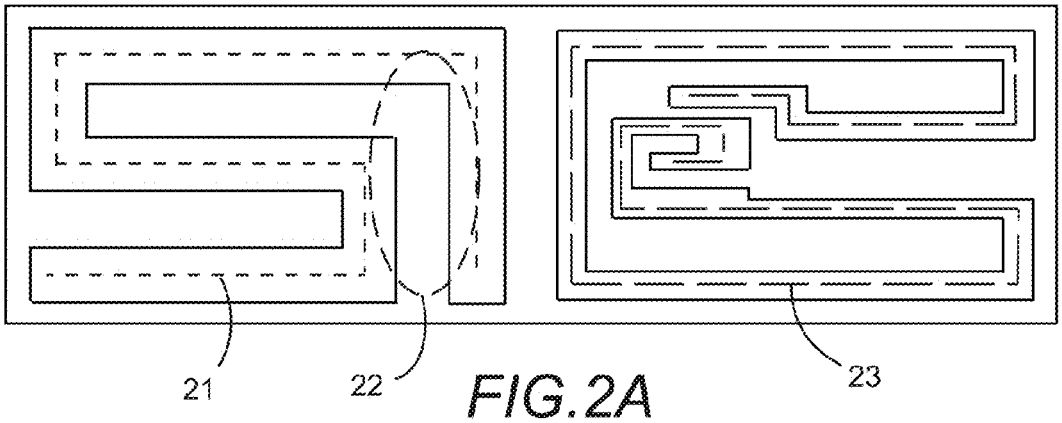
FIG. 2A shows the multipath open loop antenna and certain associated current distribution pathways.

FIG. 2A shows the multipath open loop antenna and certain associated current distribution pathways. The ground conductor portion 13 is configured to provide a first current distribution path 21 and a second current distribution path 22. The radiating conductor portion 12 is configured to provide a third current distribution path 23.

Figure 2B:
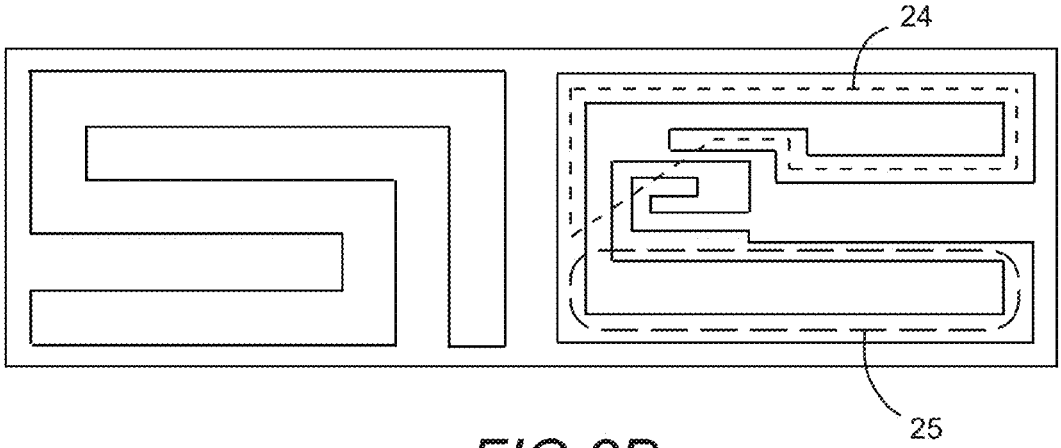
FIG. 2B shows the multipath open loop antenna and certain other associated current distribution pathways.

FIG. 2B shows the multipath open loop antenna and certain other associated current distribution pathways. The radiating conductor portion 12 is further configured to provide a fourth current distribution path 24 and a fifth current distribution path 25.

Figure 2C:
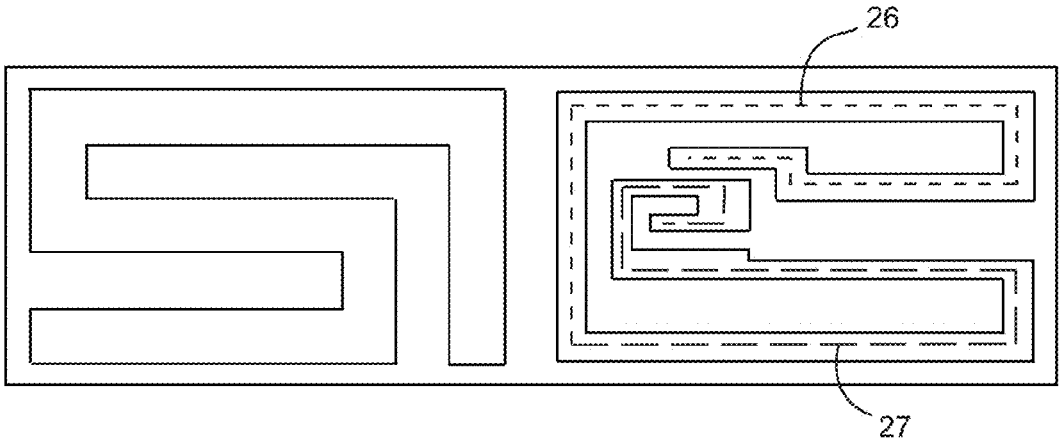
FIG. 2C shows the multipath open loop antenna and certain other associated current distribution pathways.

FIG. 2C shows the multipath open loop antenna and certain other associated current distribution pathways. The radiating conductor portion 12 is further configured to provide a sixth current distribution path 26 and a seventh current distribution path 27.

Thus, the antenna as-illustrated is configured with seven unique current distribution paths, each producing a distinct resonance for ultra-wide band response.

Figure 3:
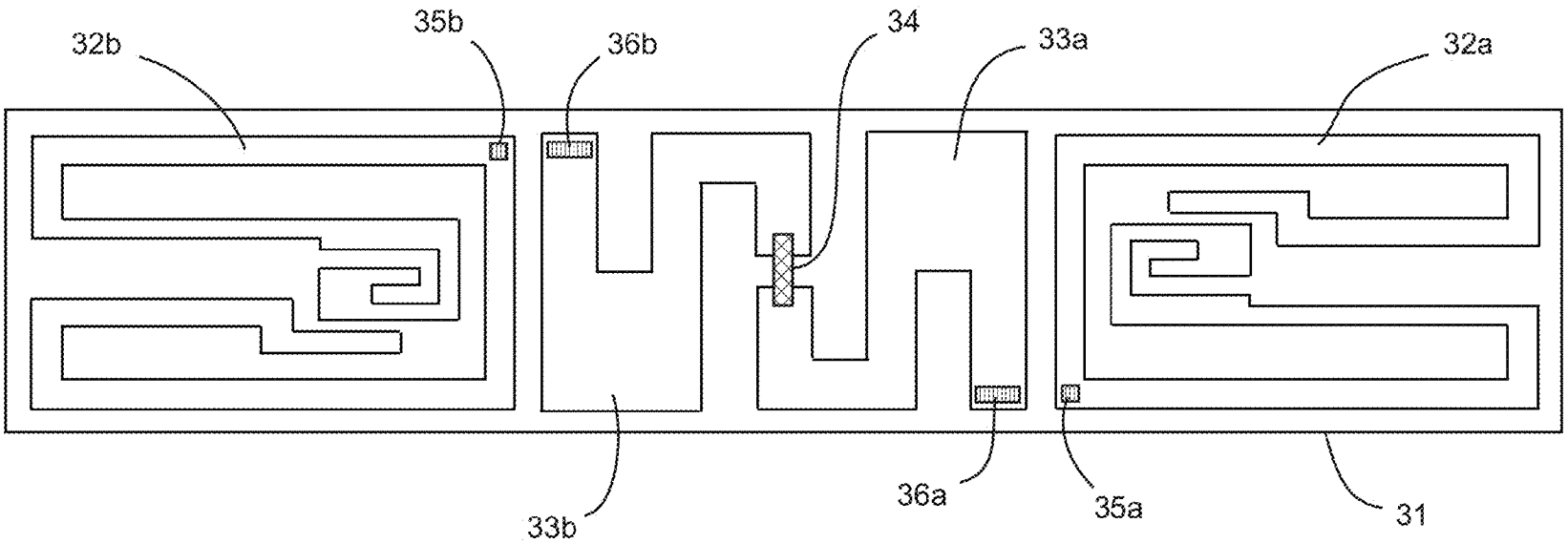
FIG. 3 shows a multipath open loop antenna in accordance with a Multi-input multi-output (MIMO) 2×2 configuration embodiment, including an optional band pass filter and a current distribution concentrators.

In another embodiment, as shown in FIG. 3, a multipath open loop antenna is arranged in accordance with a multi-input multi-output (MIMO) 2×2 configuration. In the embodiment of FIG. 3, the antenna can be configured with an optional band pass filter 34 and current distribution concentrators 33*a*; 33*b*. Here, the flexible substrate sheet comprises a pair of current distribution concentrators 33*a*; 33*b*, respectively, being coupled by a band-pass filter 34 extending therebetween. Each of the current distribution concentrators comprises a solder pad 36*a*; 36*b*, respectively, for connecting a transceiver to ground. On either side of the current distribution concentrators is a distinct radiating conductor portion 32*a*; 32*b* as described in the embodiment of FIGS. 1-2, wherein a first of the two radiating conductor portions 32*a* is a mirror image of the second radiating conductor portion 32*b*. Each of the radiating conductor portions 32*a*; 32*b* comprises a feed solder pad 35*a*; 35*b* as described above.

The disclosed antenna, having a MIMO 2×2 configuration as shown in FIG. 3, was reduced to a functional prototype and tested. The prototype antenna substrate had a size of 96 mm×21 mm×0.1 mm, having copper conductors on a flexible substrate (polyimide). The prototype antenna achieved the following resonances: 700, 850, 900, 1575, 1700, 1800, 1900, 2100, 2400 and 2600 MHz. Such an antenna can be useful with LTE-Advanced and Diversity Systems, among others.

Figure 4:
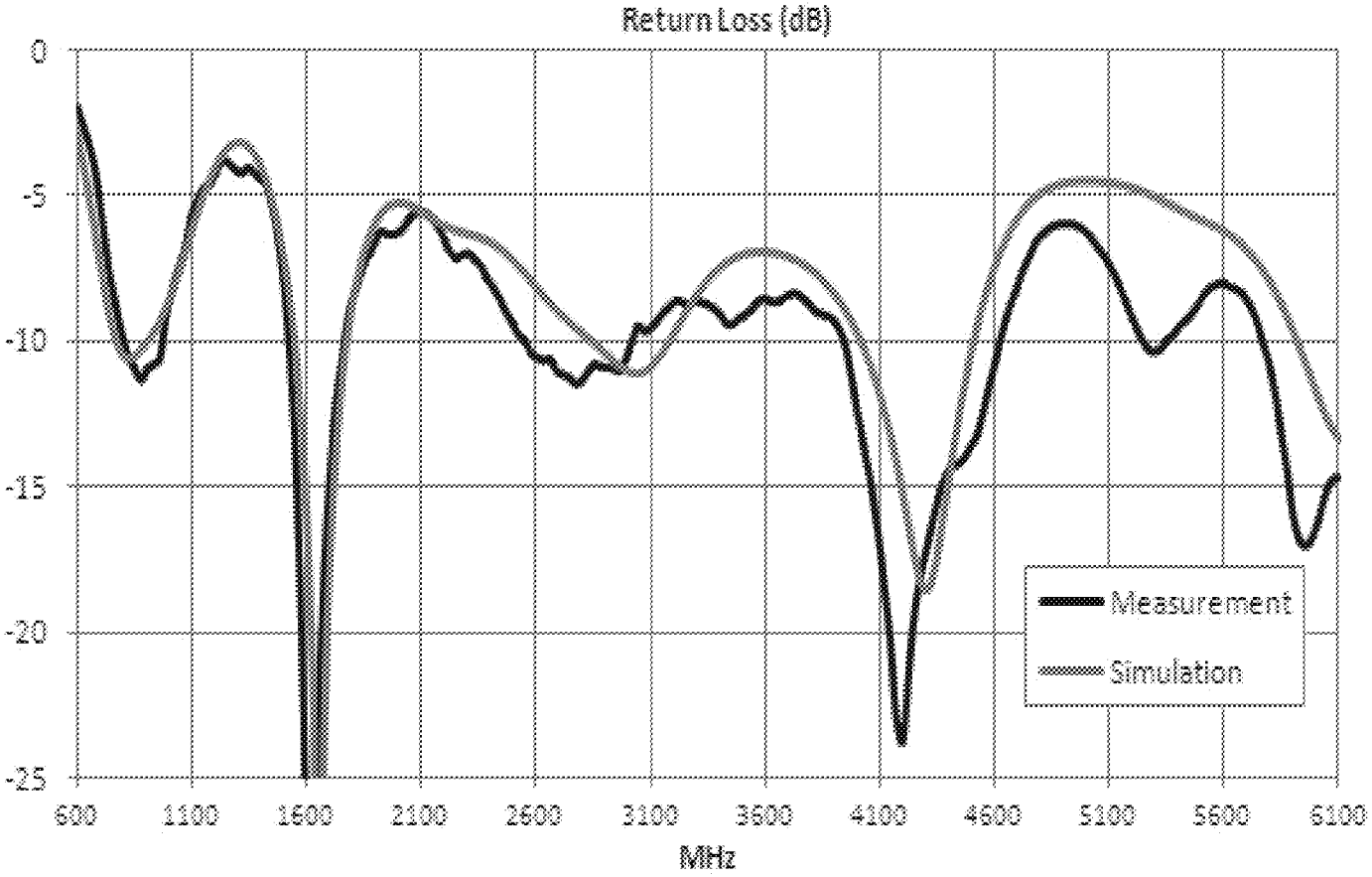
FIG. 4 shows measured and simulated return loss of the antenna of FIG. 3.
Figure 5:
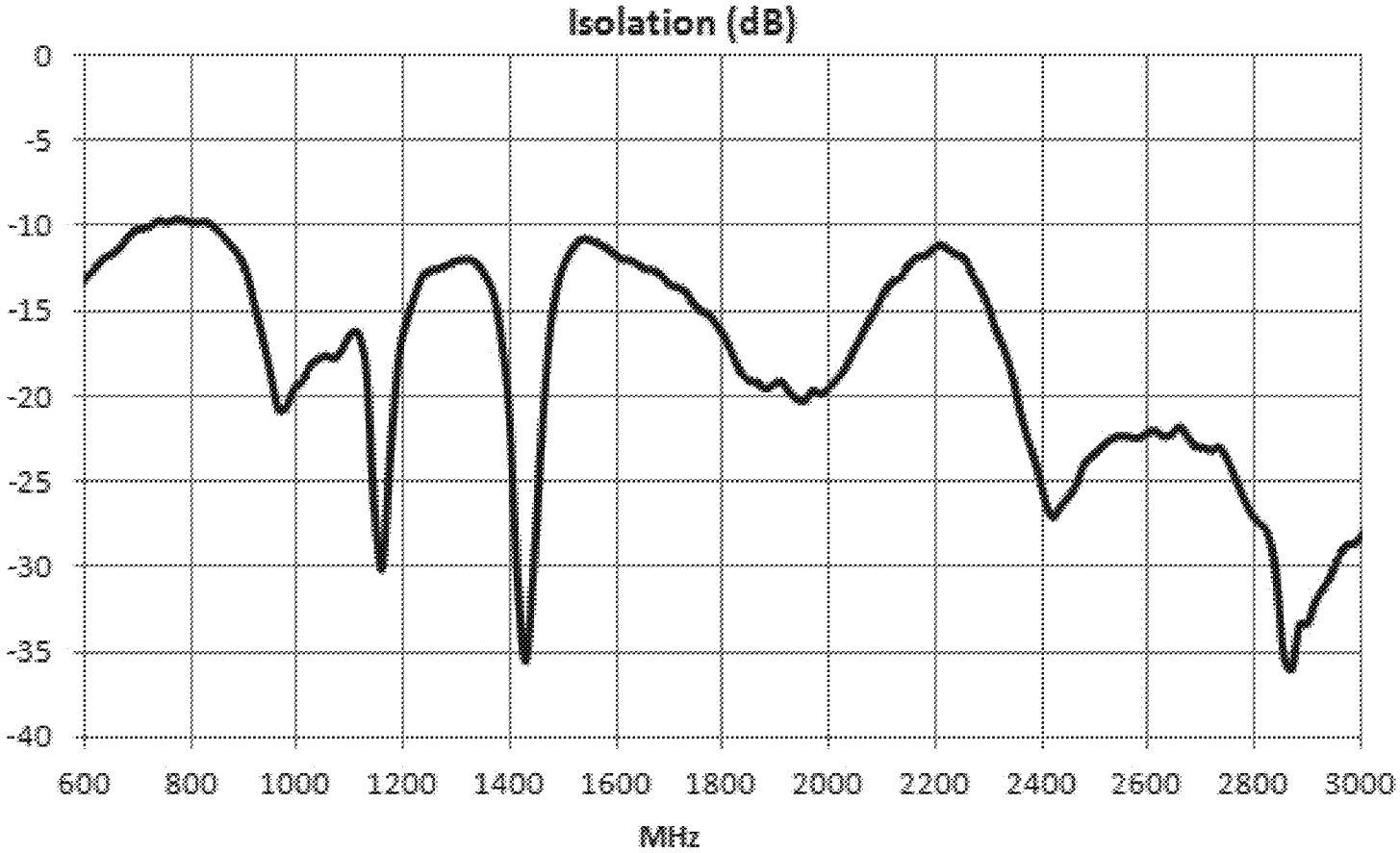
FIG. 5 shows measured isolation of the antenna of FIG. 3.
Figure 6:
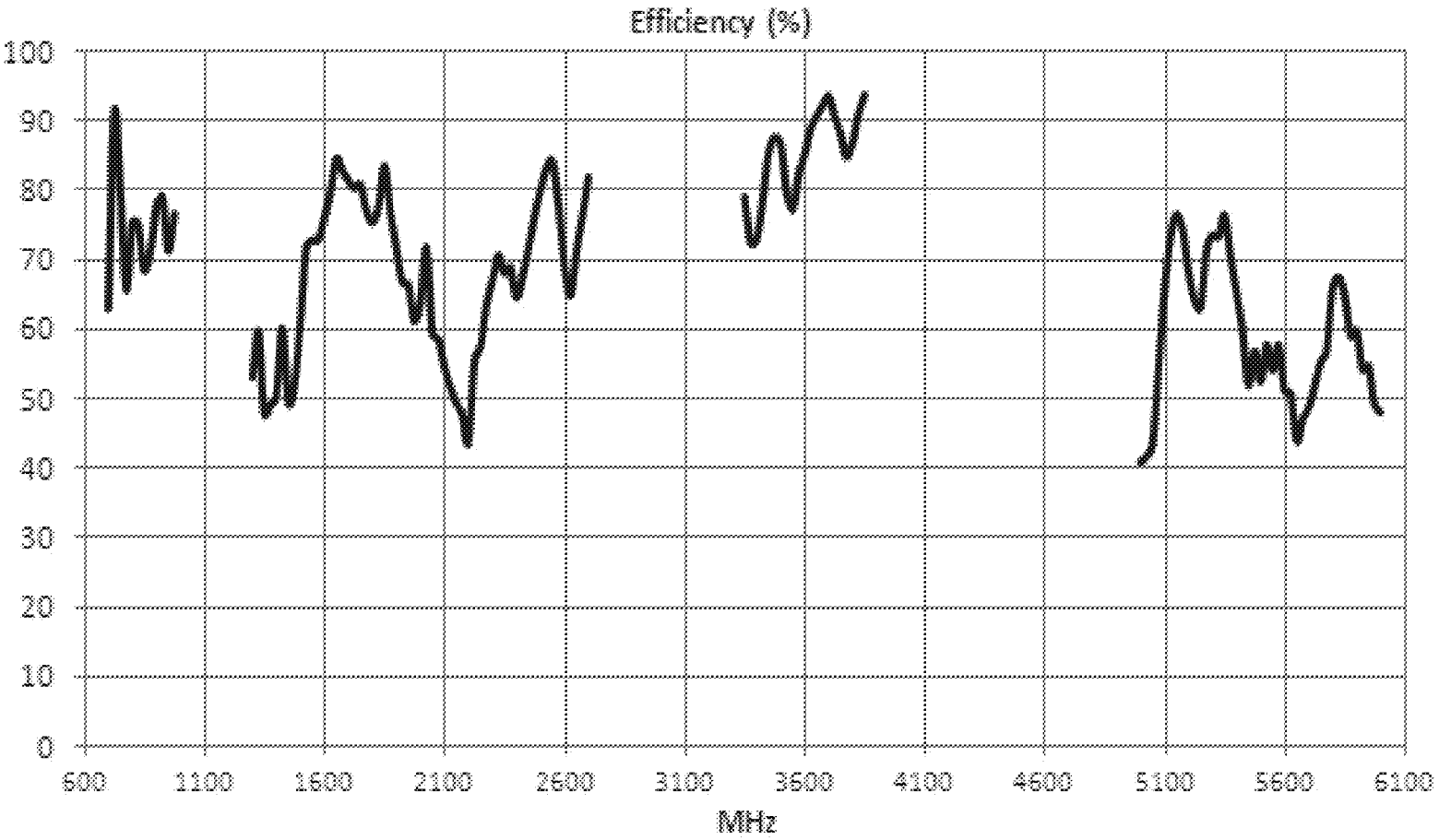
FIG. 6 shows measured efficiency of the antenna of FIG. 3.

FIG. 4 shows measured and simulated return loss of the antenna of FIG. 3;

FIG. 5 shows measured isolation of the antenna of FIG. 3;

FIG. 6 shows measured efficiency of the antenna of FIG. 3; and

Figure 7:
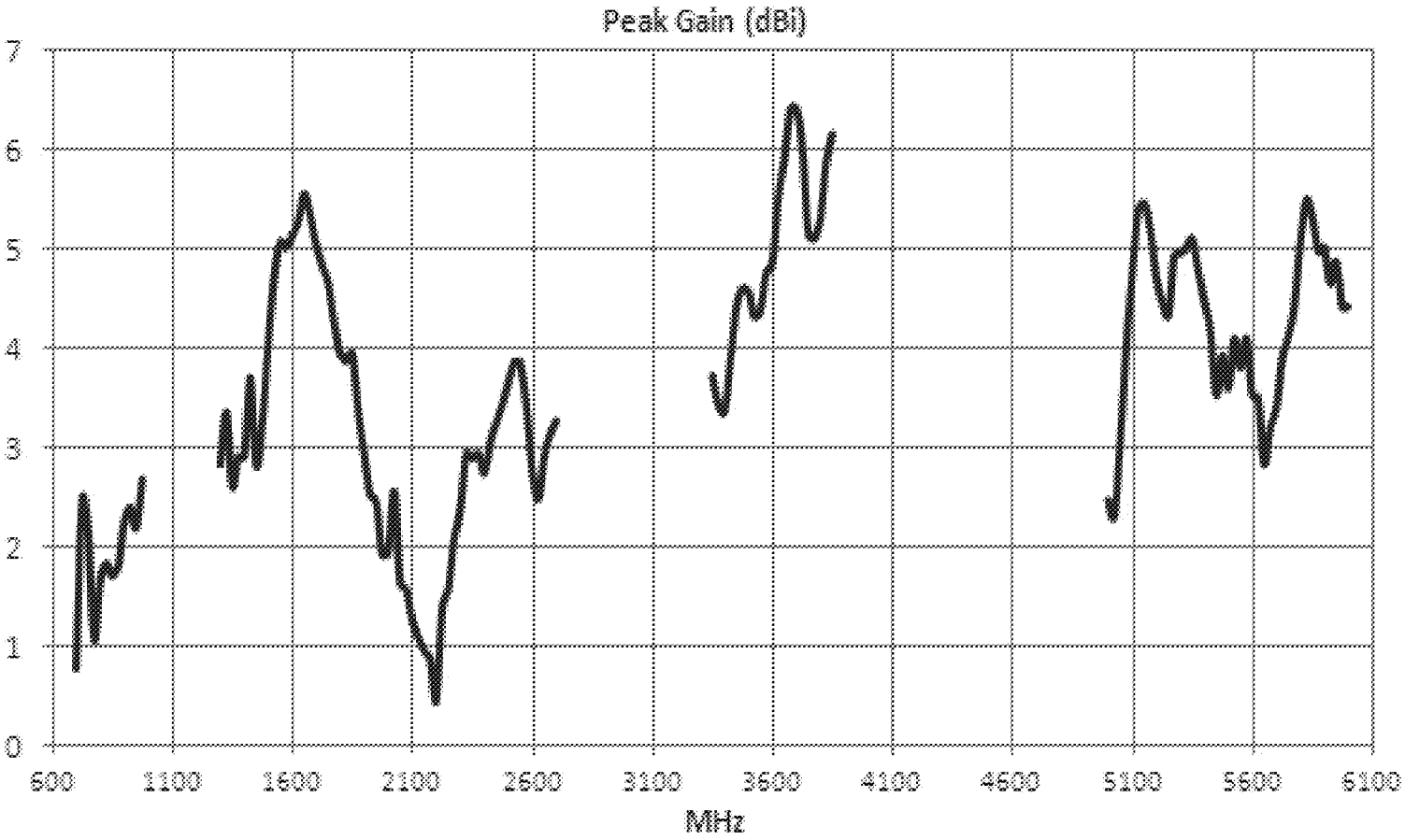
FIG. 7 shows measured peak gain of the antenna of FIG. 3.

FIG. 7 shows measured peak gain of the antenna of FIG. 3.

Depending on design requirements, the antenna can be fabricated with a flexible or rigid body that can be installed as peel and stick easy process, simplifying the assembly process while manufacturing the device in which the antenna is allocated.

Coaxial cables can be used to connect the antenna feed and ground to a transceiver.

Thus, a multipath current distribution is used to create different resonances in a limited space, and with open loops intrinsic in the design the antenna is configured to achieve wide resonance performance. Using conventional antenna design methodologies, an antenna size of 180 mm×25 mm will be required to obtain resonances down to 700 MHz band and ultra wide band characteristics. Accordingly, by using multipath current distribution the antenna size was decreased in half, providing a significant improvement in the state of the art.

Moreover, providing the antenna on a flexible substrate body allows for conforming with the shape of the surface where the antenna is to be mounted, or alternatively bending the antenna one or multiple times to fit in a tight volume.

The disclosed antenna has several current distribution paths based in open loop structures formulating multipath resonances. A MIMO arrangement of 2×2, with an isolator gap was incorporated to increase the correlation coefficient and isolation. In the MIMO 2×2 configuration a near field concentrator was added to boost isolation.

What is claimed is:

1. A multi-path open loop antenna, comprising:

a substrate sheet having a length greater than a width thereof forming a rectangular shape, and further having a periphery comprising a first peripheral edge, a second peripheral edge opposite of the first peripheral edge, and a pair of terminal edges being disposed on either side of the substrate;

a first open-loop radiating conductor disposed adjacent to one of said terminal edges;

said first open-loop radiating conductor further comprising a first feed solder pad, a first conductor section and a second conductor section, each of said first and second conductor sections individually comprising at least one loop region; and a second open-loop radiating conductor, the second open-loop radiating conductor being configured as a mirror image of the first open-loop radiating conductor; and a current distribution concentrator disposed between said first and second open-loop radiating portions; wherein said current distribution concentrator includes the first ground conductor portion and a second ground conductor portion, the second ground conductor portion being coupled to the first ground conductor portion via a band pass filter extending therebetween.

2. The antenna of claim 1, wherein the second ground conductor portion is configured as a mirror image of the first ground conductor portion.

3. The antenna of claim 2, said antenna being configured as a 2×2 MIMO antenna configuration.

4. The antenna of claim 1, wherein said substrate sheet comprises a flexible polyimide substrate sheet.

5. The antenna of claim 1, wherein said first ground conductor portion and first open-loop radiating conductor are configured to provide multipath current distribution for ultra-wide band response.

* * * * *